US012173931B2

(12) United States Patent
Liang et al.

(10) Patent No.: US 12,173,931 B2
(45) Date of Patent: Dec. 24, 2024

(54) WATER HEATER WITH CONVENIENT-TO-INSTALL DECORATIVE PLATE

(71) Applicant: JUNSKY APPLIANCES LIMITED, Zhongshan (CN)

(72) Inventors: Delong Liang, Zhongshan (CN); Zhigang Jiang, Zhongshan (CN)

(73) Assignee: JUNSKY APPLIANCES LIMITED, Zhongshan (CN)

( * ) Notice: Subject to any disclaimer, the term of this patent is extended or adjusted under 35 U.S.C. 154(b) by 62 days.

(21) Appl. No.: 18/104,240

(22) Filed: Jan. 31, 2023

(65) Prior Publication Data

US 2023/0408146 A1 Dec. 21, 2023

(30) Foreign Application Priority Data

Jun. 20, 2022 (CN) ..... 202221544576.0

(51) Int. Cl.
*F24H 9/02* (2006.01)

(52) U.S. Cl.
CPC ..... *F24H 9/02* (2013.01)

(58) Field of Classification Search
CPC ... F24H 9/02; F24H 9/06; F24D 19/06; F24D 19/064; F24D 19/067
See application file for complete search history.

(56) References Cited

U.S. PATENT DOCUMENTS

| | | | | |
|---|---|---|---|---|
| 11,890,886 | B2 * | 2/2024 | Fukui | B05D 3/067 |
| 11,940,181 | B2 * | 3/2024 | Kakizaki | F24H 9/02 |
| 2015/0139629 | A1 * | 5/2015 | Crowe | F24H 9/02 29/428 |
| 2019/0093920 | A1 * | 3/2019 | Fukui | F24H 1/181 |
| 2022/0235967 | A1 * | 7/2022 | Kawano | F24H 9/02 |
| 2023/0044778 | A1 * | 2/2023 | Fukui | B29C 64/112 |

FOREIGN PATENT DOCUMENTS

| | | | |
|---|---|---|---|
| CN | 211695420 U | * | 10/2020 |
| CN | 215571293 U | * | 1/2022 |
| CN | 217636217 U | * | 10/2022 |

* cited by examiner

*Primary Examiner* — Gregory A Wilson
(74) *Attorney, Agent, or Firm* — Birchwood IP

(57) ABSTRACT

The present disclosure relates to water heaters, in particular to a water heater with convenient-to-install decorative plate. The water heater includes top, bottom decorative plate, front plate, rear housing, further includes frame. The frame includes body, upper, lower connecting bar. The rear edge of upper connecting bar is provided with first upper flanging, rear edge of lower connecting bar is provided with first lower flanging, front edge of top decorative plate is provided with second upper flanging, front edge of bottom decorative plate is provided with second lower flanging, the first upper flanging is in lap joint with the second upper flanging, second lower flanging is in lap joint with first lower flanging. Advantages: the left, right rear part of top decorative plate each can connected upper pressing bar with one screw, top and bottom decorative plate needs two screws separately. Water heater with convenient-to-install decorative plate has few screws.

8 Claims, 8 Drawing Sheets

WATER HEATER WITH CONVENIENT-TO-INSTALL DECORATIVE PLATE

CROSS-REFERENCE TO RELATED APPLICATIONS

This is a U.S. patent application which claims the priority and benefit of Chinese Patent Application Number 202221544576.0, filed on Jun. 20, 2022, the disclosure of which is incorporated herein by reference in its entirety.

TECHNICAL FIELD

The present disclosure relates to the field of water heaters, in particular to a water heater with a convenient-to-install decorative plate.

BACKGROUND

The present application discloses a gas water heater enclosure and a gas water heater. Several first connecting structures are arranged on two sides of a face shell assembly, and several second connecting structures corresponding to the first connecting structures are arranged on two sides of a bottom shell assembly to connect the two sides of the face shell assembly to the two sides of the bottom shell assembly. One of the first connecting structure and the second connecting structure is an L-shaped hook, and the other is a hook clamping slot. The top edge of the face shell assembly is provided with several third connecting structures, and an upper plate of the bottom shell assembly is provided with several fourth connecting structures corresponding to the third connecting structures to connect the top of the face shell assembly to the top of the bottom shell assembly. One of the third connecting structure and the fourth connecting structure is a snap, and the other is a clamping slot. The bottom of the face shell assembly and a lower plate of the bottom shell assembly are connected through screws.

To securely install the lower plate of the bottom shell assembly, the number of screws used for connection between the bottom of the face shell assembly and the lower plate of the bottom shell assembly is 3 or more, generally 4-6 to ensure that the edge of the lower plate is uniformly provided with screws, avoiding local warping of the lower plate. Similarly, the top of the water heater also needs 3 or more screws to avoid the warping of a top plate. The problems of the prior art are that there are many screws at the top and bottom of the water heater, and the installation is not convenient enough.

SUMMARY

To solve the problems above, the present disclosure aims to provide a water heater with a convenient-to-install decorative plate, which has few screws at the top and bottom, and is convenient to install.

The technical solution of the present disclosure to solve the problems is: provided is a water heater with a convenient-to-install decorative plate, including a top decorative plate, a bottom decorative plate, a front plate, and a rear housing, where the cross section of the rear housing is in a U shape with an opening forward, and the top and bottom of the rear housing each are provided with a rear flanging turning inward;

further including a frame, an upper pressing bar, and a lower pressing bar, the frame being a vertically arranged rectangle, the upper pressing bar and the lower pressing bar each being in a U shape with an opening backward, and the front plate being fixed installed at the front side of the frame; and the upper pressing bar and the lower pressing bar each include a connecting lug, the frame is provided with a first connecting hole, the frame is connected to the connecting lug through the first connecting hole, the left rear part and the right rear part of the top decorative plate are both fixedly connected to the upper pressing bar, and the left rear part and the right rear part of the bottom decorative plate are both fixedly connected to the lower pressing bar. The front part of the upper pressing bar and the front part of the lower pressing bar are both hooked to the frame, and the left rear part and the right rear part of the top decorative plate each can be fixedly connected to the upper pressing bar with just one screw, so the top decorative plate only needs two screws. The bottom decorative plate only needs two screws as well. Therefore, the water heater with a convenient-to-install decorative plate of the present disclosure has few screws at the top and bottom, and is convenient to install.

As a further improvement of the above technical solution, the frame includes a frame body, an upper connecting bar, and a lower connecting bar, the upper part and the lower part of the frame body each are provided with a positioning platform, the upper connecting bar and the lower connecting bar each are provided with a positioning slot, the positioning platform and the positioning slot are mutually matched and clamped, and the upper connecting bar and the lower connecting bar each are provided with the first connecting hole. As the frame includes the frame body, the upper connecting bar, and the lower connecting bar, and the first connecting holes are arranged in the upper connecting bar and the lower connecting bar, the processing difficulty of the frame can be reduced.

As a further improvement of the above technical solution, the rear edge of the upper connecting bar is provided with a first upper flanging, the rear edge of the lower connecting bar is provided with a first lower flanging, the front edge of the top decorative plate is provided with a second upper flanging, the front edge of the bottom decorative plate is provided with a second lower flanging, the first upper flanging is in lap joint with the second upper flanging, and the second lower flanging is in lap joint with the first lower flanging. Attribute to the cooperation between the first upper flanging and the second upper flanging, the front and rear relative positions of the upper connecting bar and the top decorative plate can be limited, avoiding the mismatch between the first upper flanging and the second upper flanging. Similarly, attribute to the cooperation between the first lower flanging and the second lower flanging, the front and rear relative positions of the lower connecting bar and the top decorative plate can be limited. In addition, the second lower flanging is in lap joint with the first lower flanging. The first lower flanging can support the second lower flanging to avoid the rear edge of the bottom decorative plate from hanging down.

As a further improvement of the above technical solution, the first upper flanging is L-shaped, the second upper flanging is in a U shape with an opening upward, and the rear side wall of the first upper flanging closely abuts against the inner wall of the second upper flanging, such that the front and rear positions of the top decorative plate are reliable. The rear side wall of the first lower flanging closely abuts against the second lower flanging, such that the front and rear positions of the bottom decorative plate are reliable.

As a further improvement of the above technical solution, the second upper flanging is provided with a notch, and the notch is used for avoidance of the connecting lug. The second upper flanging is avoided from interfering with the connecting lug.

As a further improvement of the above technical solution, a connecting piece is further included. The first lower flanging is also provided with a second connecting hole, the bottom decorative plate is provided with a bottom connecting hole, the front end of the connecting piece penetrates through the bottom connecting hole and the second connecting hole in sequence, the front end of the connecting piece is fixedly connected to the lower connecting bar, and the rear end of the connecting piece is blocked at the rear side of the bottom connecting hole by the bottom connecting hole. It is inevitable that there is a gap between the connecting lug and the first connecting hole, and the frame body inevitably has a certain possibility of deformation. When the lower part of the frame body is tensioned forward, or the lower part of the frame body is convex forward and deformed, there will be a gap between the lower connecting bar and the bottom decorative plate, and by fixedly connecting the first flanging and the bottom decorative plate through the connecting piece, the gap can be avoided.

As a further improvement of the above technical solution, the lower connecting bar and the bottom decorative plate are both connected to the connecting piece with screws to avoid the lower connecting bar and the bottom decorative plate from detaching from the connecting piece.

As a further improvement of the above technical solution, the number of the connecting pieces is two, and the two connecting pieces are arranged along the left-right direction. The two connecting pieces arranged left and right can fix the lower connecting bar and the left part and the right part of the bottom decorative plate.

As a further improvement of the above technical solution, the upper pressing bar and the lower pressing bar are both made of plastic, the upper pressing bar is integrally formed, and the lower pressing bar is integrally formed. The upper pressing bar and the lower pressing bar have complex shapes, bear low force, and thus are suitable to be produced integrally from plastic.

As a further improvement of the above technical solution, the top of the rear housing is provided with a first rear flanging turning inward, the bottom of the rear housing is provided with a second rear flanging turning inward, the edge of the top decorative plate is arranged on the lower side of the first rear flanging, the upper pressing bar is arranged on the upper side of the first rear flanging, the edge of the bottom decorative plate is arranged on the upper side of the second rear flanging, and the lower pressing bar is arranged on the lower side of the second rear flanging. The first rear flanging can support the upper pressing bar. The first rear flanging can also shield the edge of the top decorative plate for decoration. The second rear flanging can support and shield the bottom decorative plate for decoration.

The beneficial effects of the present disclosure are as follows: the front part of the upper pressing bar and the front part of the lower pressing bar are both hooked to the frame, and the left rear part and the right rear part of the top decorative plate each can be fixedly connected to the upper pressing bar with just one screw, so the top decorative plate only needs two screws. The bottom decorative plate only needs two screws as well. Therefore, the water heater with a convenient-to-install decorative plate of the present disclosure has few screws at the top and bottom, and is convenient to install.

BRIEF DESCRIPTION OF DRAWINGS

The present disclosure will be further described below in conjunction with the drawings and specific implementations.

Figure 1:
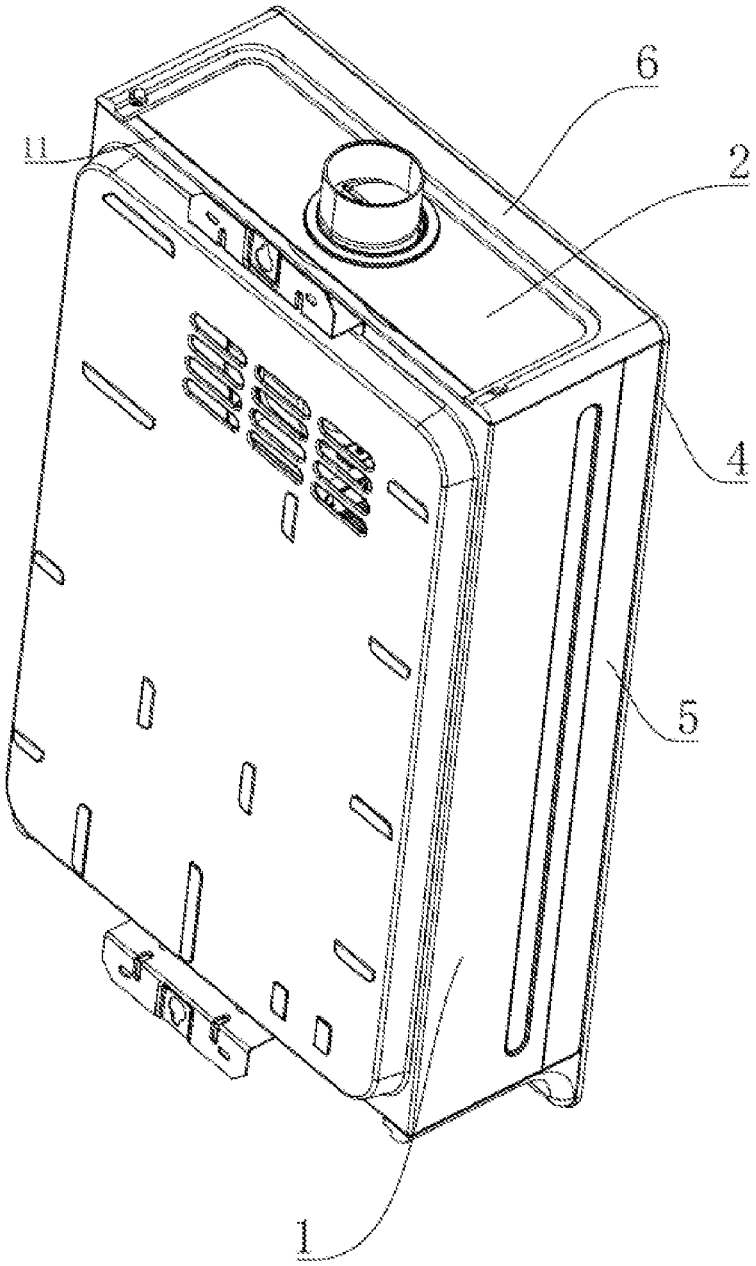
FIG. 1 is a three-dimensional view of the present disclosure.

In the drawings: 1—rear housing, 11—rear flanging, 2—top decorative plate, 21—second upper flanging, 22—notch, 3—bottom decorative plate, 31—second lower flanging, 32—bottom connecting hole, 4—front plate, 5—frame, 51—frame body, 511—positioning platform, 52—upper connecting bar, 521—first upper flanging, 53—lower connecting bar, 531—first lower flanging, 532—lower installation hole, 533—second connecting hole, 54—first connecting hole, 56—positioning slot, 6—upper pressing bar, 7—lower pressing bar, 8—connecting lug, 9—connecting piece, 91—through hole, and 10—screw.

DETAILED DESCRIPTION

The specific embodiments of the present disclosure will be described in detail in this part. The preferred embodiments of the present disclosure are shown in the attached drawings. The drawings serve to supplement the written description of the specification with figures, such that each technical feature and the entire technical solution of the present disclosure can be intuitively and visually understood, but they cannot be understood as the limitation to the protection scope of the present disclosure.

In the description of the present disclosure, it should be understood that as for orientation description, the indicated orientation or positional relationship such as upper, lower, front, rear, left and right are based on the orientation or positional relationship shown in the drawings, and only used for facilitating the description of the present disclosure and simplifying the description, rather than indicating or implying that a device or an element specified must have a specific orientation, and be constructed and operated in a specific orientation, and thus cannot be understood as a limit to the present disclosure.

In the description of the present disclosure, "several" means one or more, "a plurality of" means two or more, "larger than", "less than", "more than", and the like should be understood as exclusion of the number, and "above", "below", "within", and the like should be understood as inclusion of the number. In addition, the terms "first" and "second" (if any) are only used for the purpose of distinguishing the technical features, and cannot be understood as indicating or implying the relative importance, or implicitly indicating the quantity of the indicated technical features, or implicitly indicating the sequence of the indicated technical features.

In the description of the present disclosure, unless otherwise expressly defined, the terms such as "arrangement", "installation" and "connection" should be understood in a broad sense, and those skilled in the art can reasonably determine the specific meaning of the terms above in the present disclosure in conjunction with the specific content of the technical solution.

Referring to FIGS. 1-11, provided is a water heater with a convenient-to-install decorative plate.

Figure 2:
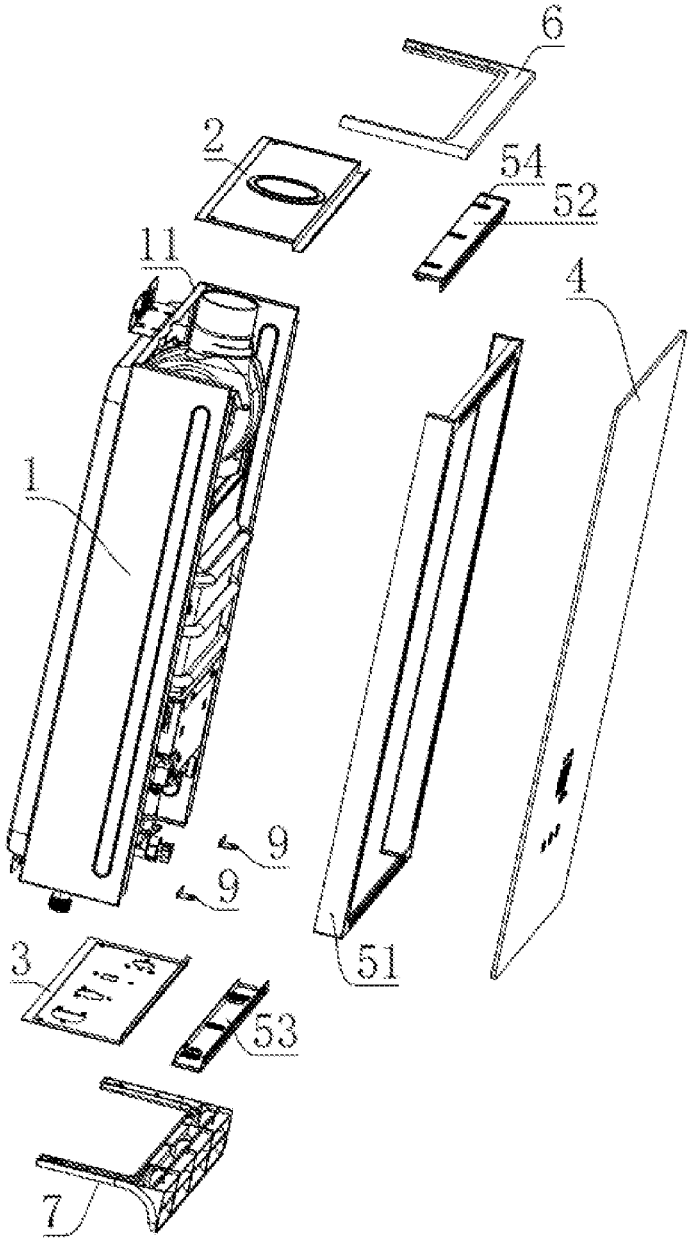
FIG. 2 is a three-dimensional exploded view of the present disclosure.

Referring to FIGS. 1 and 2, a rear housing 1 is included. The cross section of the rear housing 1 is in a U shape with an opening forward. The top and bottom of the rear housing 1 each are provided with a rear flanging 11 turning inward.

A top decorative plate 2, a bottom decorative plate 3, a front plate 4, an upper pressing bar 6, and a lower pressing bar 7 are further included.

Figure 6:
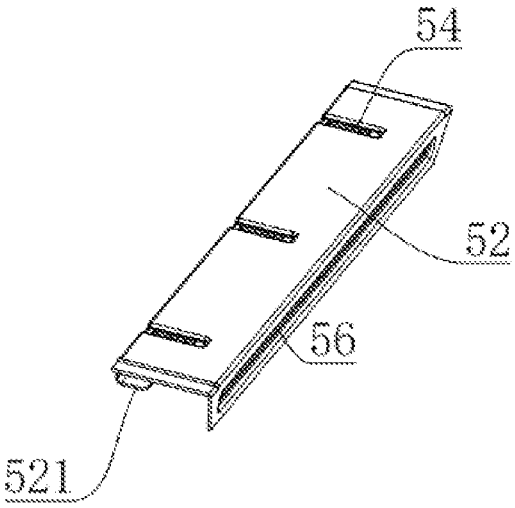
FIG. 6 is a structural diagram of an upper connecting bar of the present disclosure.
Figure 7:
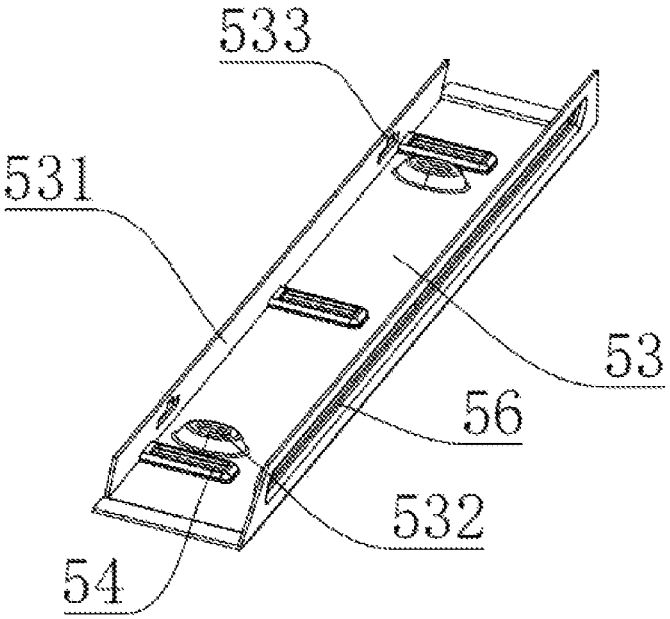
FIG. 7 is a structural diagram of a lower connecting bar of the present disclosure.
Figure 10:
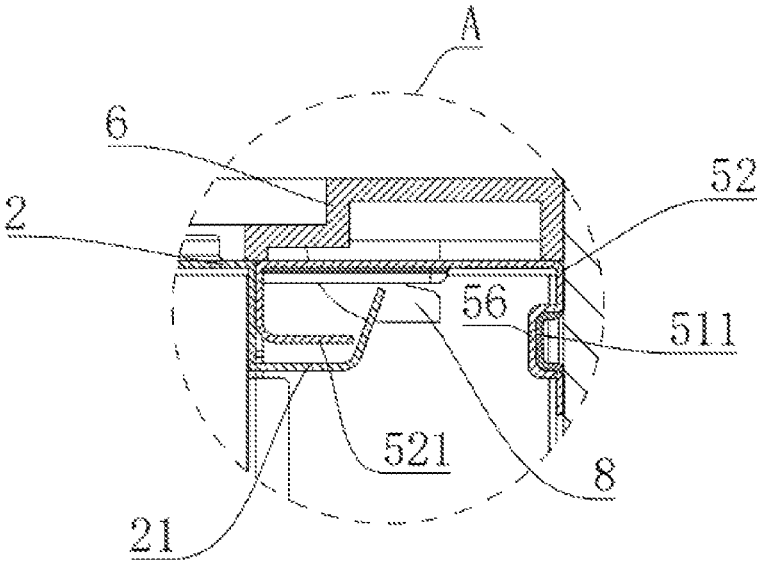
FIG. 10 is an enlarged view of part A in FIG. 9.
Figure 11:
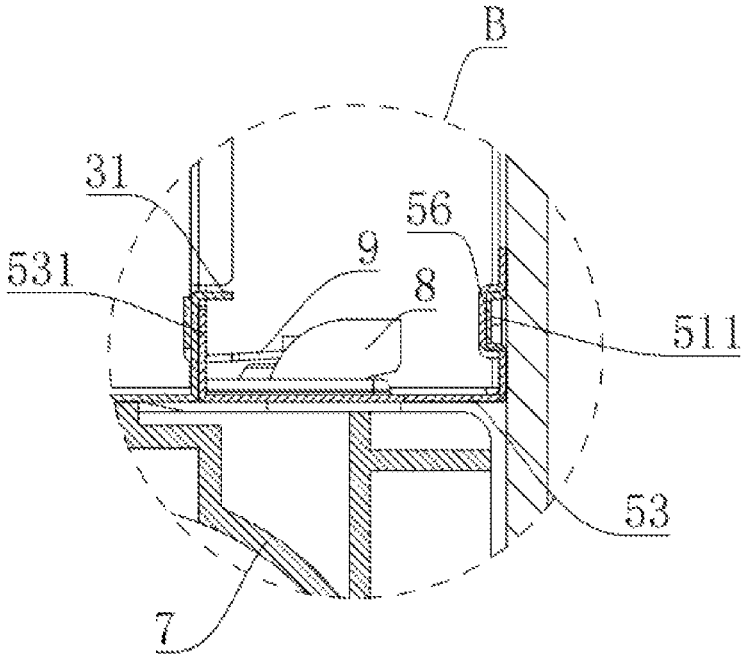
FIG. 11 is an enlarged view of part B in FIG. 9.

A frame 5 is further included. The frame 5 includes a frame body 51, an upper connecting bar 52, and a lower connecting bar 53. Referring to FIG. 2, the frame body 51 is a vertically arranged rectangle. Referring to FIGS. 10 and 11, the upper part and the lower part of the frame body 51 each are provided with a positioning platform 511. Referring to FIGS. 6 and 7, the upper connecting bar 52 and the lower connecting bar 53 each are provided with a positioning slot 56. The positioning platform 511 and the positioning slot 56 are mutually matched and clamped. The upper connecting bar 52 and the lower connecting bar 53 each are provided with the first connecting hole 54.

Referring to FIG. 6, the rear edge of the upper connecting bar 52 is provided with a first upper flanging 521. The first upper flanging 521 is L-shaped. Referring to FIG. 7, the rear edge of the lower connecting bar 53 is provided with a first lower flanging 531. The first lower flanging 531 is also provided with a second connecting hole 533.

The front plate 4 is welded to the front side of the frame body 51.

Figure 3:
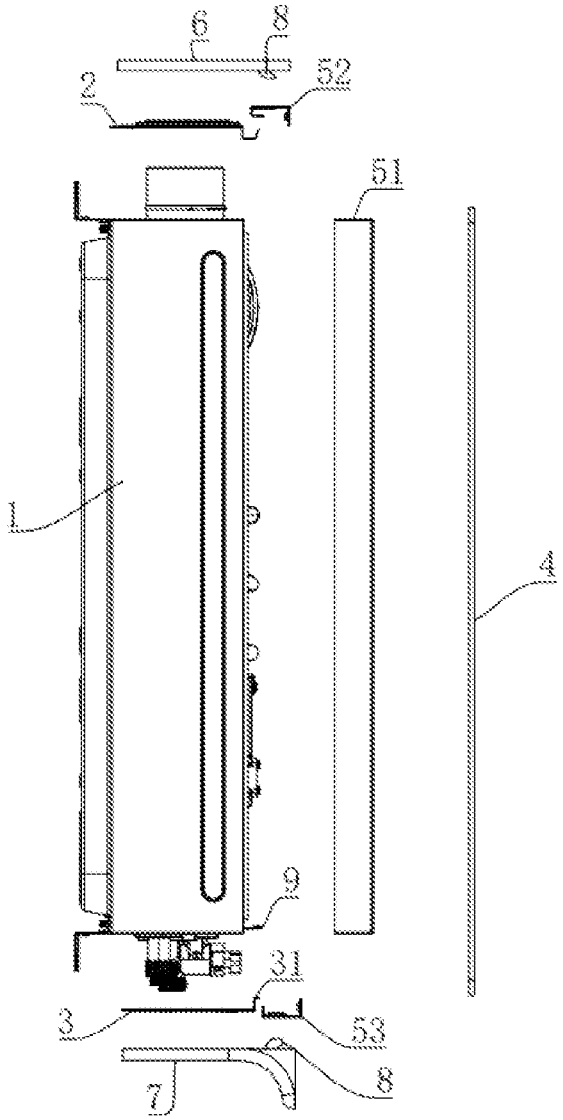
FIG. 3 is a side exploded view of the present disclosure.

Referring to FIGS. 2 and 3, the upper pressing bar 6 and the lower pressing bar 7 are both made of plastic. The upper pressing bar 6 and the lower pressing bar 7 each are integrally formed. The upper pressing bar 6 and the lower pressing bar 7 each are in a U shape with an opening backward. The upper pressing bar 6 and the lower pressing bar 7 each include a connecting lug 8. Referring to FIGS. 10 and 11, one end of the connecting lug 8 passes through the first connecting hole 54.

Figure 12:
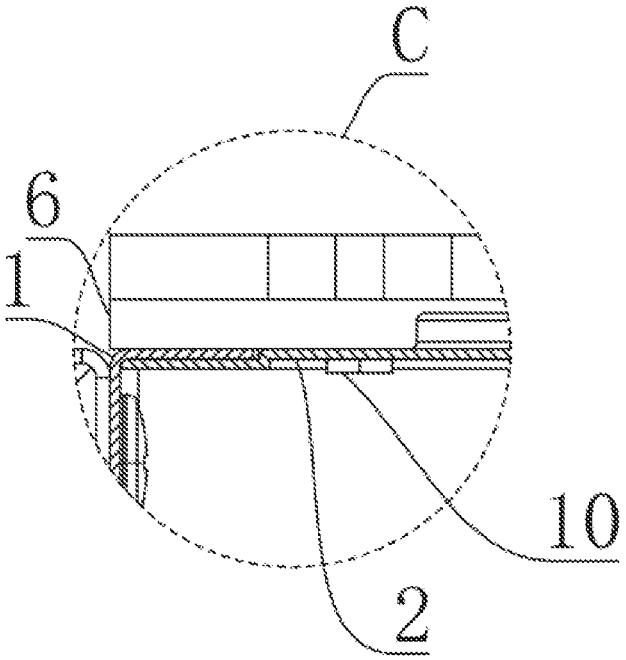
FIG. 12 is an enlarged view of part C in FIG. 9.
Figure 13:
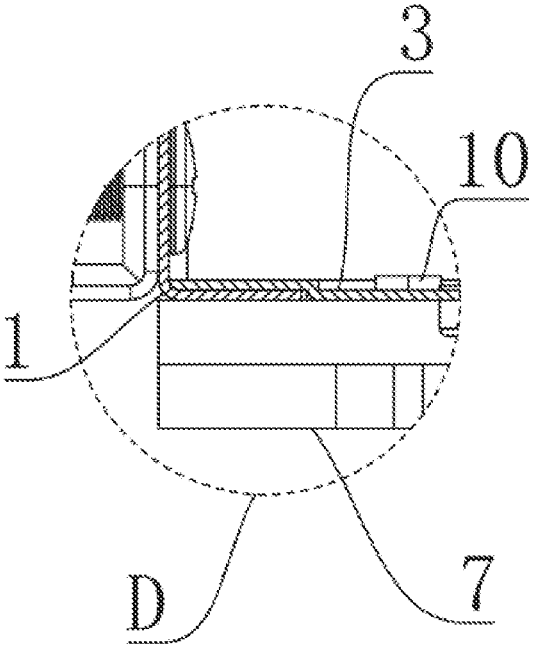
FIG. 13 is an enlarged view of part D in FIG. 9.

Referring to FIGS. 1, 12 and 13, the left rear part and the right rear part of the top decorative plate 2 each are fixedly connected to the upper pressing bar 6 with one screw 10. The left rear part and the right rear part of the bottom decorative plate 3 each are fixedly connected to the lower pressing bar 7 with one screw 10.

Figure 4:
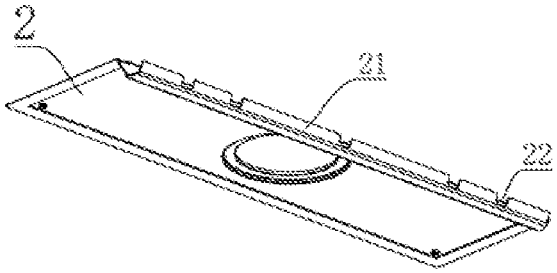
FIG. 4 is a structural diagram of a top decorative plate of the present disclosure.

Referring to FIG. 4, the front edge of the top decorative plate 2 is provided with a second upper flanging 21. The second upper flanging 21 is a U shape with an opening upward. The first upper flanging 521 extends downward into the opening of the second upper flanging 21. Referring to FIG. 10, the rear side wall of the first upper flanging 521 closely abuts against the inner wall of the second upper flanging 21. The second upper flanging 21 is provided with a notch 22. The notch 22 is used for avoidance of the connecting lug 8.

Figure 5:
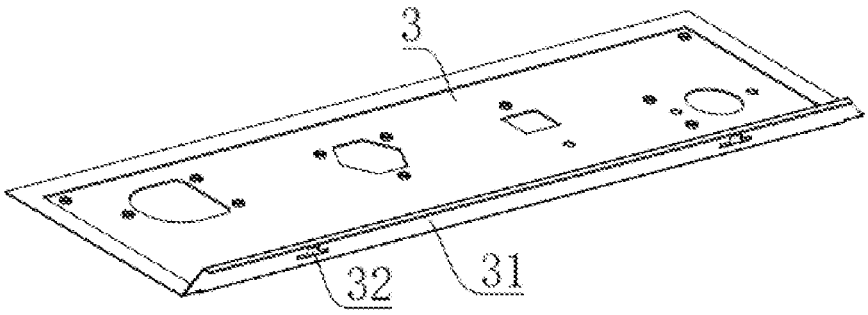
FIG. 5 is a structural diagram of a bottom decorative plate of the present disclosure.

Referring to FIG. 5, the front edge of the bottom decorative plate 3 is provided with a second lower flanging 31. The bottom decorative plate 3 is provided with a bottom connecting hole 32. The second lower flanging 31 is in lap joint with the first lower flanging 531. Referring to FIG. 11, the rear side wall of the first lower flanging 531 closely abuts against the second lower flanging 31.

Figure 8:
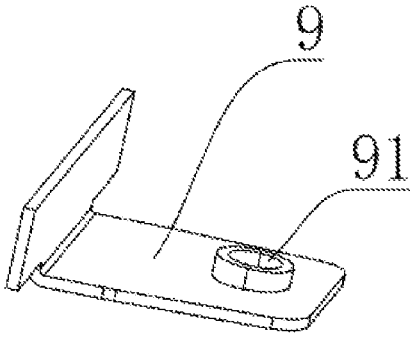
FIG. 8 is a structural diagram of a connecting piece of the present disclosure.
Figure 9:
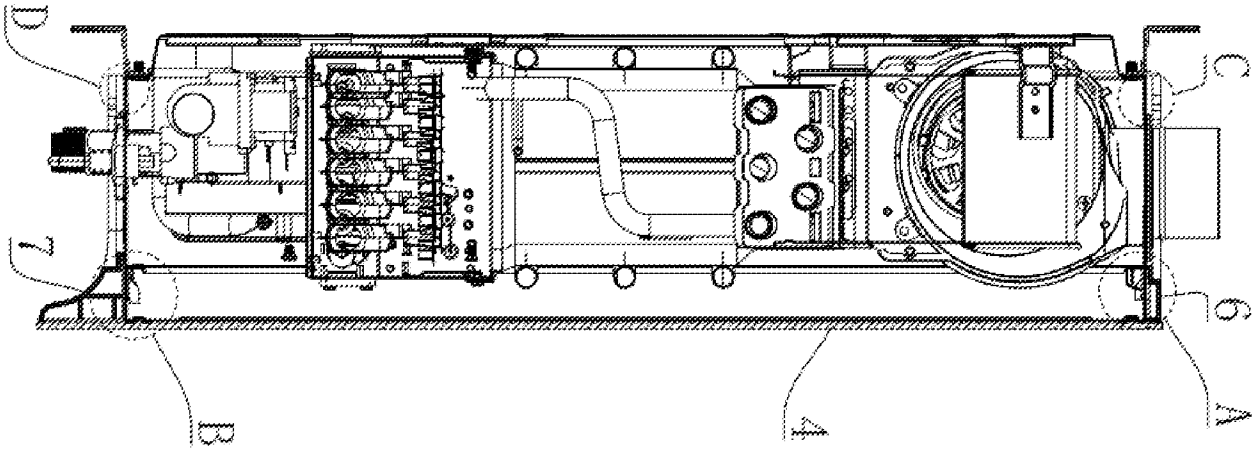
FIG. 9 is a cross-sectional view of the present disclosure.

Referring to FIGS. 2, 8 and 11, a connecting piece 9 is further included. The front end of the connecting piece 9 penetrates through the bottom connecting hole 32 and the second connecting hole 533 in sequence. The front end of the connecting piece 9 is provided with a through hole 91. The through hole 91 is fixedly connected to a lower installation hole 532 through a screw 10. The rear end of the connecting piece 9 is blocked at the rear side of the bottom connecting hole 32 by the bottom connecting hole 32.

The above is only the preferred embodiments of the present disclosure, and does not limit the claims of the present disclosure. Under the conception of the present disclosure, the equivalent structure transformations made according to the contents of the specification and the attached drawings of the present disclosure, or directly or indirectly used in other related technical fields are all included in the scope of patent protection of the present disclosure.

What is claimed is:

1. A water heater with a convenient-to-install decorative plate, comprising a top decorative plate, a bottom decorative plate, a front plate, and a rear housing, wherein a cross section of the rear housing is in a U shape with an opening forward;

further comprising a frame, an upper pressing bar, and a lower pressing bar, the frame is a vertically arranged rectangle; the upper pressing bar and the lower pressing bar are both in a U shape with an opening backward, and the front plate is fixedly installed at a front side of the frame; and the upper pressing bar and the lower pressing bar both comprise a connecting lug, a left rear part and a right rear part of the top decorative plate are both fixedly connected to the upper pressing bar; a left rear part and a right rear part of the bottom decorative plate are both fixedly connected to the lower pressing bar;

wherein the frame comprises a frame body, an upper connecting bar, and a lower connecting bar; an upper part and a lower part of the frame body are both provided with a positioning platform; the upper connecting bar and the lower connecting bar are both provided with a positioning slot and a first connecting hole.

2. The water heater with a convenient-to-install decorative plate according to claim 1, wherein a rear edge of the upper connecting bar is provided with a first upper flanging, a rear edge of the lower connecting bar is provided with a first lower flanging, a front edge of the top decorative plate is provided with a second upper flanging, a front edge of the bottom decorative plate is provided with a second lower flanging, the first upper flanging is in lap joint with the second upper flanging, and the second lower flanging is in lap joint with the first lower flanging.

3. The water heater with a convenient-to-install decorative plate according to claim 2, wherein the first upper flanging is L-shaped, the second upper flanging is provided with an opening upward, and a rear side wall of the first upper flanging closely abuts against an inner wall of the second upper flanging; and a rear side wall of the first lower flanging closely abuts against the second lower flanging.

4. The water heater with a convenient-to-install decorative plate according to claim 2, wherein the second upper flanging is provided with a notch, and the notch is used for avoidance of the connecting lug.

5. The water heater with a convenient-to-install decorative plate according to claim 2, further comprising a connecting piece, the first lower flanging is further provided with a second connecting hole, the bottom decorative plate is provided with a bottom connecting hole, a front end of the connecting piece penetrates through the bottom connecting hole and the second connecting hole in sequence, the front end of the connecting piece is fixedly connected to the lower connecting bar, and a rear end of the connecting piece is blocked at a rear side of the bottom connecting hole by the bottom connecting hole.

6. The water heater with a convenient-to-install decorative plate according to claim 5, wherein there are two connecting pieces, and the two connecting pieces are arranged along a left-right direction.

7. The water heater with a convenient-to-install decorative plate according to claim 1, wherein the upper pressing bar and the lower pressing bar are both made of plastic, the upper pressing bar is integrally formed, and the lower pressing bar is integrally formed.

8. The water heater with a convenient-to-install decorative plate according to claim 1, wherein a top of the rear housing is provided with a first rear flanging turning inward, a bottom of the rear housing is provided with a second rear flanging turning inward, an edge of the top decorative plate is arranged on a lower side of the first rear flanging, the upper pressing bar is arranged on an upper side of the first rear flanging, an edge of the bottom decorative plate is arranged on an upper side of the second rear flanging, and the lower pressing bar is arranged on a lower side of the second rear flanging.

* * * * *